US005168733A

United States Patent [19]

Rathmann et al.

[11] Patent Number: 5,168,733

[45] Date of Patent: Dec. 8, 1992

[54] CENTRAL LOCKING DEVICE

[75] Inventors: Klaus Rathmann, Frankfurt am Main; Axel Schäfer, Bad Soden, both of Fed. Rep. of Germany

[73] Assignee: VDO Adolf Schindling AG, Frankfurt am Main, Fed. Rep. of Germany

[21] Appl. No.: 839,097

[22] Filed: Feb. 20, 1992

[30] Foreign Application Priority Data

Feb. 23, 1991 [DE] Fed. Rep. of Germany ..... 4105758

[51] Int. Cl.[5] ..... E05B 65/38

[52] U.S. Cl. ..... 70/264; 180/287; 340/825.32

[58] Field of Search ..... 70/237, 239, 257, 264; 180/287; 340/825.32

[56] References Cited

U.S. PATENT DOCUMENTS

| | | | |
|---|---|---|---|
| 3,000,204 | 9/1961 | De Vito | 70/264 |
| 3,798,936 | 3/1974 | Oliver | 70/264 |
| 4,910,980 | 3/1990 | Katoh | 70/264 X |
| 5,030,949 | 7/1991 | Reis et al. | 70/264 X |

FOREIGN PATENT DOCUMENTS

| | | | |
|---|---|---|---|
| 0245001 | 11/1987 | European Pat. Off. | 70/264 |
| 0357965 | 3/1990 | European Pat. Off. . | |
| 3612306 | 10/1987 | Fed. Rep. of Germany . | |
| 0217581 | 8/1990 | Japan | 70/264 |

*Primary Examiner*—Lloyd A. Gall
*Attorney, Agent, or Firm*—Martin A. Farber

[57] ABSTRACT

A system for the central locking of several closure points of an automotive vehicle with a remotely controlled setting member at each closure point has a central control circuit, as well as activating switches. Each switch has a neutral central position between "closed" and "open" positions at one or more closure points, by which the control circuit can be controlled for movement of all setting members in the same direction. A switch sequence of the invention provides for individual opening of a closure point by a process wherein the actuating switch must be brought into the "closed" position and then immediately into the "open" position.

3 Claims, 1 Drawing Sheet

Fig. 1
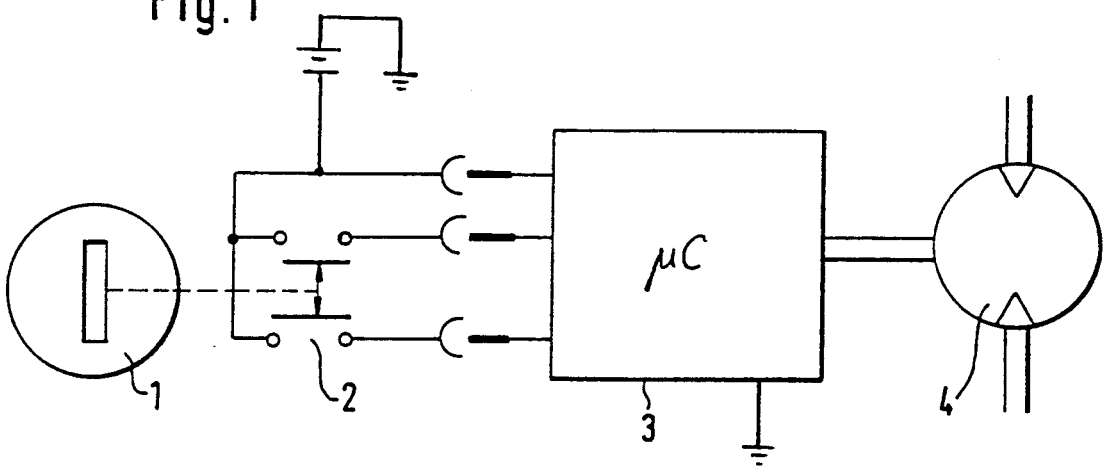
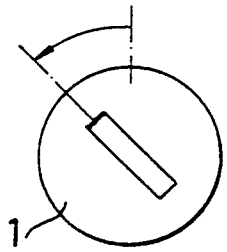
Fig. 2a
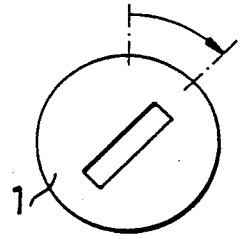
Fig. 2b
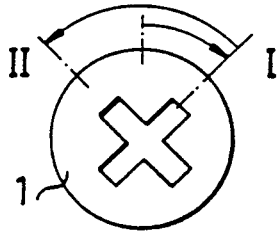
Fig. 2c

CENTRAL LOCKING DEVICE

FIELD AND BACKGROUND OF THE INVENTION

The present invention relates to a device for the central locking of several closure points in an automotive vehicle with a remote controlled setting member at each closure point. The device includes a central control circuit, as well as actuating switches having a neutral central position between "closed" and "open" positions at one or more of the closure points by which the control circuit can be controlled for the movement of all the setting members in the same direction.

In such central locking devices, it is frequently required that, aside from closing and opening movement of all setting members in the same direction upon a corresponding actuation of the switches, the possibility may be present that, in each case one closure point (for instance, the driver's door) is to be opened separately. For this, it has already been proposed to provide within the vehicle a separate switch by which the control circuit can be switched optionally from individual to complete opening, and vice versa (German OS 36 12 306). This proposal has been criticized as being unsatisfactory and, instead of it, it has been proposed that optionally only one closure point be opened when the corresponding actuating switch is brought, only a single time, into the open position; and that all closure points are to be opened when the actuating switch is brought in succession two or more times into the open position (EP-A-0 357 965).

However, this proposal is still unsatisfactory for the user. There is the objection that the two actuations which are to lead to different opening results are too similar to each other to be able to avoid erroneous actuations to the extent desirable. It is all too easy, in haste, unintentionally to give a double opening command so that all closure points are opened without this being intended and although only one was to be opened.

Furthermore, it is conceivable that initially at least one of the closure points had been opened separately (for instance, the trunk) and sometime later a second closure point was opened (for instance, the driver's door), the user having forgotten the first opening process and erroneously assuming that only the second closure point was opened.

Finally, there is concern that the opening commands for effecting an individual or a complete opening are also too little distinguished since they are in the same direction and can easily be confused in the case of lack of attention or forgetfulness. Erroneous switchings are not immediately noticed if only one closure point is to be opened since this result is obtained in both cases. In such cases, there is no reason to check whether all other closure points have remained closed since one falsely assumes that the result has been obtained with the correct command.

SUMMARY OF THE INVENTION

An object of the invention is to avoid the aforementioned deficiencies of central locking systems of the above-indicated type and to create a situation for better distinguishing between the two required opening commands.

According to the invention, the following switch sequences are provided in the control circuit:

a) If one of the actuating switches is brought into the "closed" position, all setting members move into the closed position insofar as they are not already in the closed position;

b) If one of the actuating switches is brought into the "open" position, then all setting members of the system are brought into the open position; and c) if one of the actuating switches is brought into the "closed" position and then immediately thereafter into the "open" position, then only the corresponding setting member is moved into the open position.

Furthermore it is advisable that switch sequence c) only takes place if not more than a predeterminable period of time, preferably 400 to 600 milliseconds, has elapsed between the "closing" and "opening".

BRIEF DESCRIPTION OF THE DRAWING

With the above and other objects and advantages in view, the present invention will become more clearly understood in connection with the detailed description of a preferred embodiment when considered with the accompanying drawing, of which:

FIG. 1 is a diagram of the system of the invention; and

FIGS. 2*a*, 2*b* and 2*c* together show a sequence of switch positions.

DETAILED DESCRIPTION OF THE PREFERRED EMBODIMENT

FIG. 1 shows, greatly simplified, the essential parts of the arrangement of the invention. The closure point 1 can be actuated in customary manner with a key, in which connection, a slot can be turned by the key from a neutral central position (shown in FIG. 1) by, in each case, 45° to the right and left (see FIG. 2). To this there correspond the positions of the actuating switch 2 via which a control circuit 3 (e.g. a microcompute is controlled which, in its turn, activates a (pneumatic) setting member 4. Of course, in actual practice several closure points 1 are present, each having an actuating switch 2 and a setting member 4, while ordinarily only one control circuit 3 is provided for all closure points.

FIG. 2 shows the switch sequences intended for the closure point 1. a is the position of the slot, turned 45° to the left out of the central position, which represents the "central lock open" position. FIG. 2*b* shows the "central lock closed" position while FIG. 2*c* shows the switch sequence for "individual opening of a closure point". In accordance with the invention, for this purpose—starting from the middle position—there is first of all effected a turn I to the right, i.e. in the direction of "central lock closed" and immediately thereafter a turn II to the left, i.e. in the direction of "central lock open". The user is thus provided with the possibility of individually opening a closure point by a central locking system with which, on the one hand, erroneous switchings are practically completely excluded while, on the other hand, an intentional decision must be made for the special switch sequence indicated in FIG. 2*c*, namely, first of all, a closing movement and only then an opening movement for the individual opening.

We claim:

1. A device for centrally locking several closure points in an automotive vehicle, each remote closure point having a setting member for control of the closure point, the device comprising a central control circuit, and a plurality of actuating switches, individual ones of said switches at one or more of the closure points having a neutral central position between "closed" and "open" positions by which the control circuit can be controlled for movement of all of said setting members in a common direction; and wherein said control circuit provides switch sequences wherein a) if one of the actuating switches is brought into a "closed" position, all setting members move into a closed position insofar as they are not already in the closed position;

b) if one of the actuating switches is brought into an "open" position, then all setting members are brought into an open position; and c) if one of the actuating switches is brought into the "closed" position and then immediately thereafter into the "open" position, then only the corresponding setting member is moved into the open position.

2. A locking device according to claim 1, wherein the switch sequence c) takes place only if a period of time between the "closed" and "open" position is less than a predetermined time period.

3. A locking device according to claim 2, wherein said predetermined time period is 400 to 600 milliseconds.

* * * * *